US005781219A

United States Patent [19]

Kouzai et al.

[11] Patent Number: 5,781,219

[45] Date of Patent: Jul. 14, 1998

[54] INK SHEET AND THERMAL TRANSFER TYPE COLOR PRINTER

[75] Inventors: Fumio Kouzai; Syoichiro Hayashi, both of Hiroshima, Japan

[73] Assignee: Mitsubishi Denki Kabushiki Kaisha, Tokyo, Japan

[21] Appl. No.: 391,457

[22] Filed: Feb. 21, 1995

[30] Foreign Application Priority Data

Feb. 22, 1994 [JP] Japan ..... 6-024274
Oct. 28, 1994 [JP] Japan ..... 6-265351

[51] Int. Cl.[6] ..... B41J 31/00

[52] U.S. Cl. ..... 347/178; 347/217

[58] Field of Search ..... 347/177, 217, 347/178; 400/207

[56] References Cited

U.S. PATENT DOCUMENTS 4,496,955 1/1985 Maeyama et al. .

FOREIGN PATENT DOCUMENTS 0119275 9/1984 European Pat. Off. .
63-233883 9/1988 Japan .
64-5879 1/1989 Japan .
4357069 12/1992 Japan .

*Primary Examiner*—Huan H. Tran
*Attorney, Agent, or Firm*—Sughrue, Mion, Zinn, Macpeak & Seas, PLLC

[57] ABSTRACT

An ink sheet for a thermal transfer type color printer. In the ink sheet, a head sensor mark is provided in a transparent portion on one side of a base film, one identification sensor mark is provided in a boundary between specific colorants, and no sensor marks are provided in boundaries between other colorants. In order to reduce the cost of the ink sheet, the sensor marks are composed of the cyan or black colorant itself.

10 Claims, 15 Drawing Sheets

FIG. 4(A)

| SENSOR / INK COLOR | INFRARED LIGHT | RED LIGHT | GREEN LIGHT |
|---|---|---|---|
| Y | 1 | 1 | 1 |
| M | 1 | 1 | 0 |
| C | 1 | 0 | 1 |
| BK | 0 | 0 | 0 |
| SENSOR MARK | 0 | 0 | 0 |

"1": LIGHT IS TRANSMITTED

"0": LIGHT IS SHIELDED

FIG. 4(B)

| SENSOR / INK COLOR | INFRARED LIGHT | RED LIGHT | GREEN LIGHT |
|---|---|---|---|
| Y | 1 | 1 | 1 |
| M | 1 | 1 | 0 |
| C | 1 | 0 | 1 |
| BK | 1 | 0 | 0 |
| SENSOR MARK | 0 | 0 | 0 |

"1": LIGHT IS TRANSMITTED

"0": LIGHT IS SHIELDED

INK SHEET AND THERMAL TRANSFER TYPE COLOR PRINTER

BACKGROUND OF THE INVENTION

The present invention relates to an ink sheet and a thermal transfer type color printer to which the ink sheet is suitably applied.

FIG. 17 is a side view showing an arrangement of the primary portion of a conventional thermal transfer type color printer disclosed in Japanese Patent Unexamined Publication No. Sho. 64-5879. FIG. 18 is a plan view showing an ink sheet. In the drawing, reference numeral 1 designates a platen; 2, a thermal head having a linear type heating element mounted on a radiating plate 2*a*; 3, a print sheet; and 4, an ink sheet. As illustrated in FIG. 18, the ink sheet 4 is prepared by coating or printing a set of colorants including yellow (Y) 4*b*, magenta (M) 4*c*, cyan (C) 4*d* and black (BK) 4*e* on a transparent base film 4*a* so as to correspond respectively to an area of the print sheet. In some cases, the colorant of black (BK) 4*e* is excluded and a set of 3 colors are provided on the transparent base film. There are provided a head sensor mark 4*f* for detecting the lead color of each set of colorants, and an identification (ID) mark 4*g* for identifying the type of the ink sheet in order to make the ink sheet coincide with a print start position of each color. These head sensor mark 4*f* and ID mark 4*g* compose the sensor marks. In general, the head sensor mark 4*f* and ID mark 4*g* are made of a coating material containing carbon black, the light-shielding property of which is higher than that of each colorant, or made of a vapor-deposited aluminum film. Reference numeral 5 designates an ink sheet feed roll; 6, an ink sheet winding roll; and 7, a sensor. In general, a transmission type infrared light sensor is used for the sensor 7. When the head sensor mark 4*f* and the ID mark 4*g* shield a light beam, the detection level is changed. In accordance with the change in the detection level, the head sensor mark 4*f* and the ID mark 4*g* are detected.

Next, the operation will be explained below. Simultaneously when the print sheet 3 is sent to the print start position, the ink sheet 4 is also conveyed from the ink sheet feed roll 5 to the ink sheet winding roll 6. When the sensor 7 detects the head sensor mark 4*f*, conveyance of the ink sheet 4 is stopped. While the print sheet 3 and the ink sheet 4 are held on the platen 1 by the thermal head 2 and an electrical signal corresponding to an image to be printed is impressed upon the thermal head 2, the platen 1 is rotated at a predetermined speed. First, the colorant of yellow 4*b* is thermally transferred onto the print sheet 3. After the completion of the printing operation of yellow, the thermal head 2 is separated from the platen 1, and the print sheet 3 is returned to the print start position, and at the same time, the ink sheet 4 is conveyed so that the next colorant comes to the print start position. When the ID mark 4*g* is detected by the sensor 7 in the process of conveyance of the ink sheet 4, the ink sheet 4 is stopped, and the thermal head 2 is contacted with the platen 1, and the printing operation of the next colorant (magenta 4*c*) is carried out. in the same manner as described above, the colorants of cyan 4*d* and black 4*e* are thermally transferred, so that a printed image can be formed on the print sheet.

The conventional thermal transfer type color printer and ink sheet are composed in the manner explained above, and the head sensor mark 4*f* and ID mark 4*g* are provided at the boundary of colorants. Accordingly, the sensor 7 is installed in a range of the width of the print sheet. It is desirable that a distance between the heating line of the thermal head 2 and the sensor 7 is maintained as short as possible. However, due to the existence of the radiating plate 2*a* and a guide roller (not shown in the drawing), an appropriate distance L is necessarily required. Accordingly, the distance L from the head sensor mark 4*f* or the ID mark 4*g* to be detected by the sensor 7, to the colorant to be used for printing is a wasteful portion on the ink sheet 4. As a result, the overall length of the ink sheet 4 is extended. Due to the foregoing, the external diameters of the ink sheet feed roll 5 and the ink sheet winding roll 6 are increased.

Another conventional example is shown in FIG. 19. In the drawing, reference numerals 4 and 4*a* to 4*g* are the same as those in the above explanation. In this example, the head sensor mark 4*f* and ID mark 4*g* are arranged outside of the printing width of the thermal head 2. Accordingly, when the sensor 7 is separate from the boundary of the colorants by a distance L, the print start position can be made to be close to the boundary of the colorants. Therefore, waste of the ink sheet caused in the conventional example as described above can be avoided. However, since the sensor 7 is arranged outside of the printing width of the thermal head 2, in addition to the width W1 of the colorant, it is necessary to provide the width for installing the head sensor mark 4*f* and ID mark 4*g*. Accordingly, the width W2 of the ink sheet 4 is increased (W1<W2). Therefore, the width of the ink sheet feed roll 5 and the width of the ink sheet winding roll 6 are increased in the axial direction.

In the above conventional thermal transfer type printer, a long and wide ink sheet is used. Accordingly, depending on the head sensor mark 4*f*, the ID mark 4*g* and the position at which the sensor 7 is arranged, a roll of ink sheet of large diameter must be accommodated in the printer, or a roll of ink sheet, the width of which is wide in the axial direction, must be accommodated in the printer. Accordingly, it is difficult to reduce the size of the thermal transfer type color printer.

The sensor marks must be made of a special coating material containing carbon black for shielding infrared light, which is different from the transfer colorants. Therefore, in the process of manufacturing the ink sheet, it is necessary to provide a process to coat the special coating material for the sensor marks.

SUMMARY OF THE INVENTION

The present invention has been achieved to solve the above problems. It is an object of the present invention to provide an ink sheet, the overall length of which is short and the width of which is narrow, and also to provide a thermal transfer type color printer to which the above ink sheet can be applied.

In attaining the above object, the present invention provides an ink sheet including: a set of transfer colorants including 3 colors of yellow, magenta and cyan or 4 colors of yellow, magenta, cyan and black, the transfer colorants being successively coated or printed on a base film corresponding to an area of a print sheet while a transparent portion is provided on a side of the base film; a head sensor mark provided at a position in the transparent portion on the base film, the position corresponding to a boundary between the yellow colorant which is the lead color, and the cyan or black colorant which is the last color of each color set; and an identification sensor mark provided at a boundary between the yellow and magenta colorants.

Further, the present invention provides a thermal transfer type color printer using an ink sheet, the ink sheet including: a set of transfer colorants including 3 colors of yellow, magenta and cyan or 4 colors of yellow, magenta, cyan and black, the transfer colorants being successively coated or printed on a base film corresponding to an area of a print sheet while a transparent portion is provided on a side of the base film; a head sensor mark provided at a position in the transparent portion on the base film, the position corresponding to a boundary between the yellow colorant which is the lead color, and the cyan or black colorant which is the last color of each color set; and an identification sensor mark provided at a boundary between the yellow and magenta colorants, the color printer comprising: a red light sensor for detecting the identification sensor mark to control a conveyance of the ink sheet; and an infrared light sensor for detecting the head sensor mark, the infrared light sensor being arranged in parallel with the red light sensor.

BRIEF DESCRIPTION OF THE DRAWINGS

FIGS. 4(A) and 4(B) are schematic illustrations in which the sensor types and the transmission and shield of colorants are shown in the form of a table of truth value;

DETAILED DESCRIPTION OF THE PREFERRED EMBODIMENTS

Embodiment 1

Figure 1:
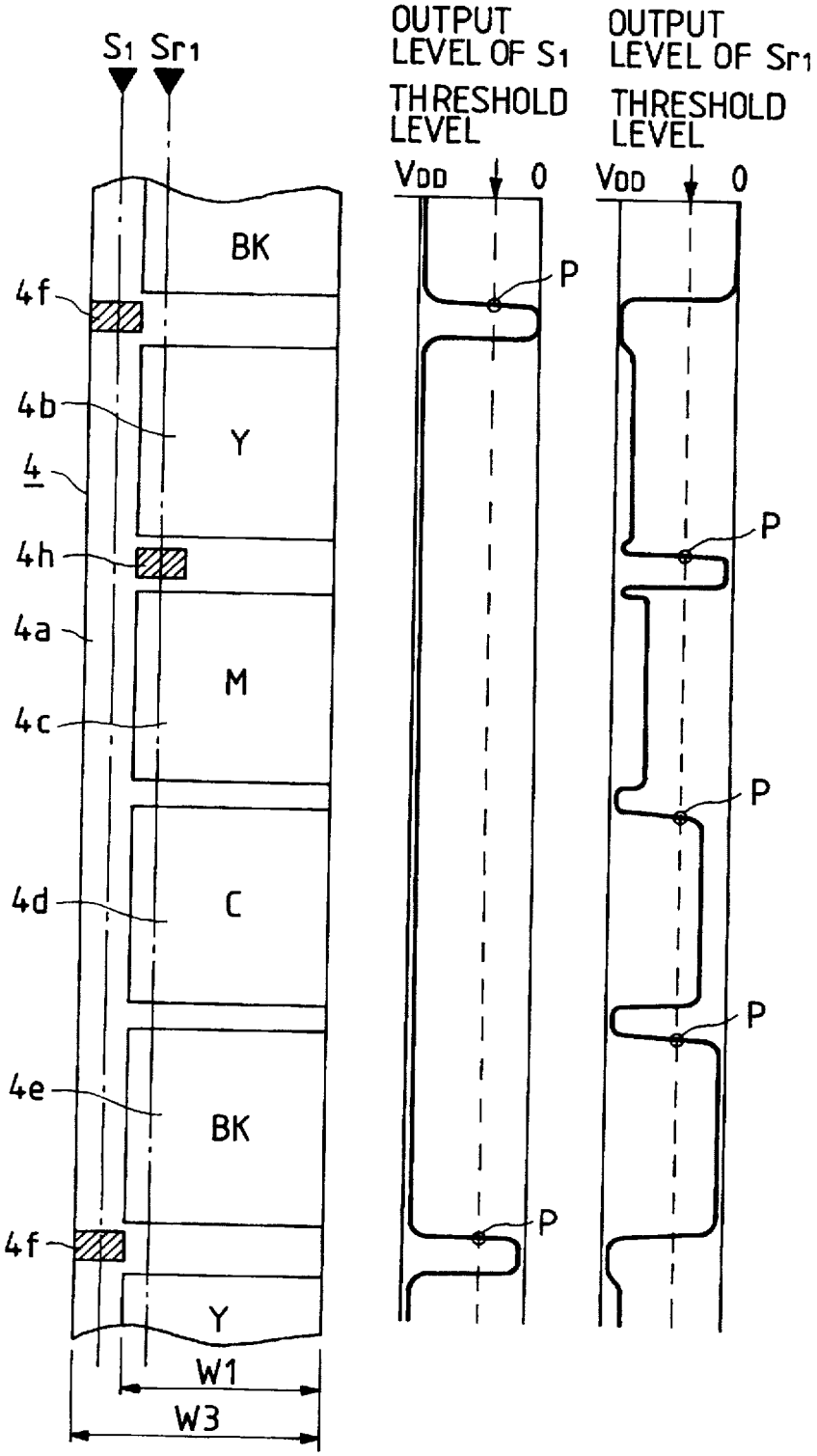
FIG. 1 is a schematic illustration showing a 4-colorant ink sheet and an output level of each sensor in a first embodiment of the present invention.
Figure 2:
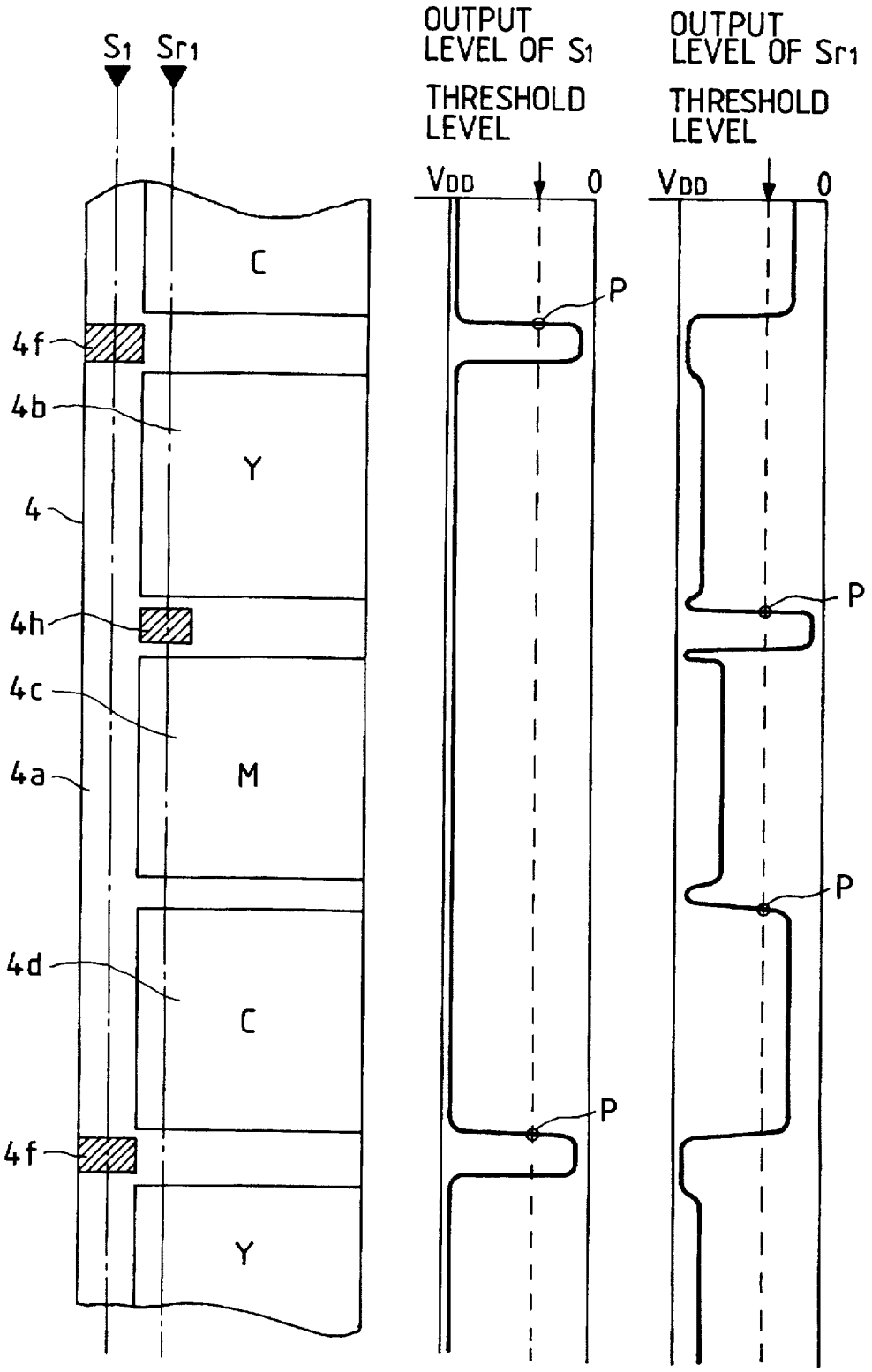
FIG. 2 is a schematic illustration showing a 3-colorant ink sheet and an output level of each sensor in the first embodiment.
Figure 3:
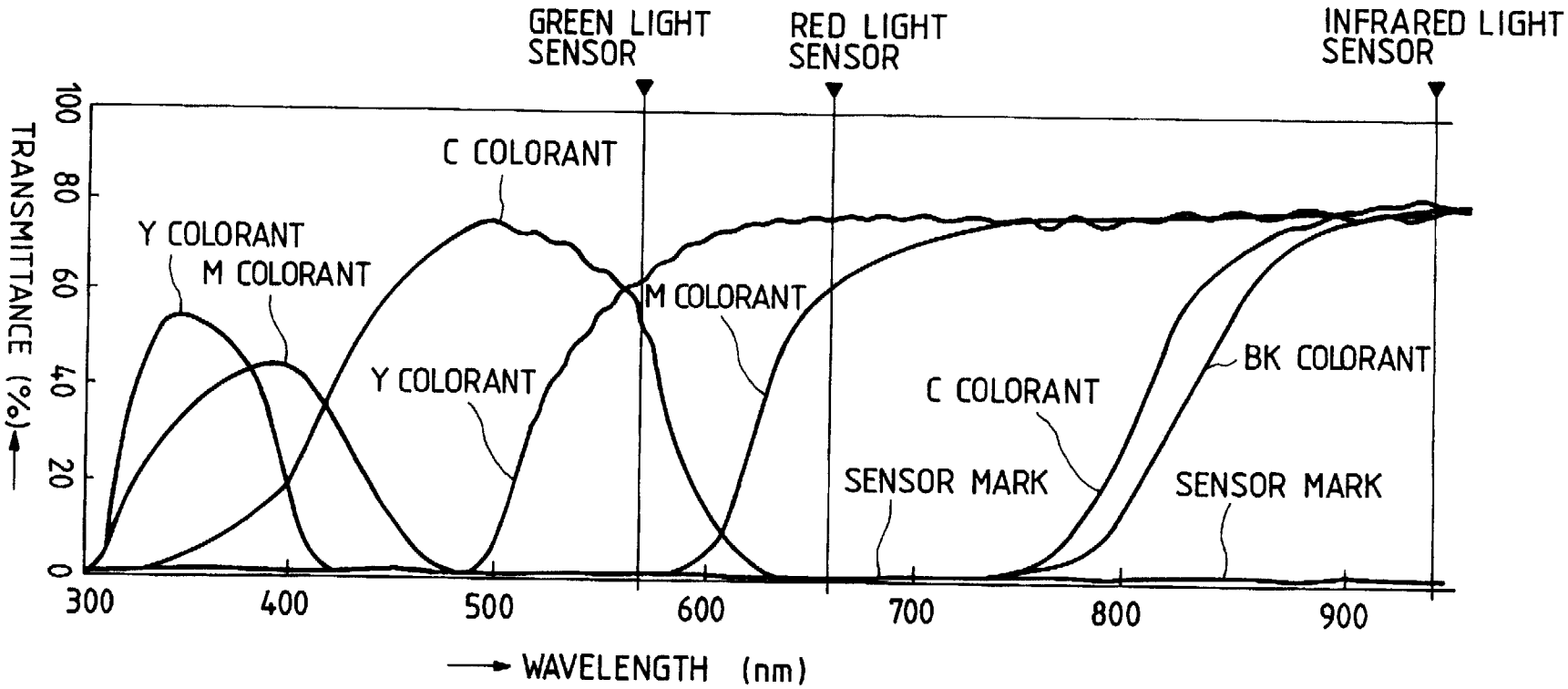
FIG. 3 is a spectral characteristic diagram showing the detection level of each colorant and sensor.
Figure 5:
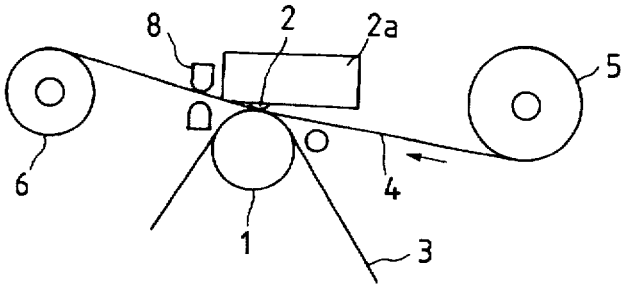
FIG. 5 is a side view showing the primary structure of the thermal transfer type color printer of the present invention.
Figure 6:
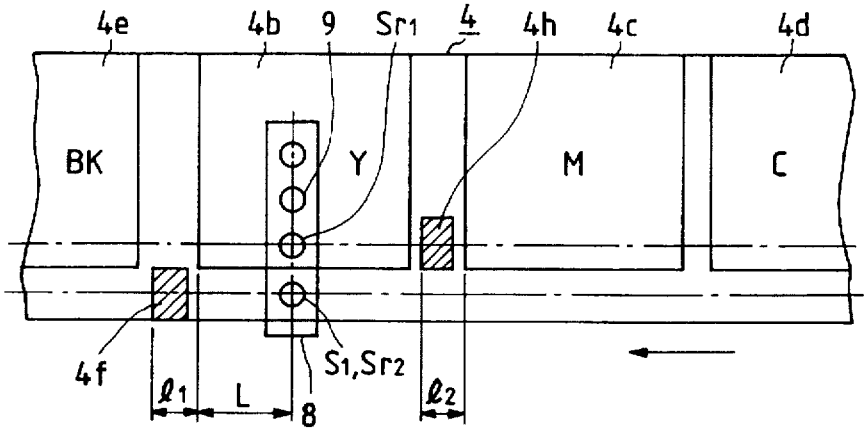
FIG. 6 is a schematic illustration showing the positional relation between the sensor and sensor mark.

FIGS. 1 and 2 are schematic illustrations showing ink sheets and sensors and further showing the output levels of the sensors in a first embodiment of the present invention. FIG. 1 illustrates an ink sheet including 4 colorants, and FIG. 2 illustrates an ink sheet including 3 colorants. FIG. 3 is a spectral characteristic diagram in which the sensed level characteristics are shown according to the types of the transfer colorants and sensors. FIGS. 4(A) and 4(B) are schematic illustrations showing tables of truth value in which the types of sensors and the transmission and shielding of colorants are shown. FIG. 4(A) shows a case in which a fusion type ink is used, and FIG. 4(B) shows a case in which a sublimation type ink is used. FIG. 5 is a side view showing an arrangement of a primary portion of the thermal transfer type color printer of the present invention. FIG. 6 is a schematic illustration showing a positional relation between the sensor and the sensor mark. In FIG. 5, reference numerals 1, 2, 3, 5 and 6 designate the same units as those of the conventional printer described before. Reference numeral 8 designates a sensor block into which a plurality of sensors are integrally assembled. This sensor block 8 is located at a position close to the heating line of the thermal head 2. As illustrated in FIG. 6, the sensor block 8 includes: a transmission type infrared light sensor S1 for detecting a sensor mark 4*f* to control the conveyance of an ink sheet; a transmission type red light sensor Sr1 for detecting an identification (ID) sensor mark 4*h*, arranged in parallel with the infrared light sensor; and a reading sensor 9 for reading the type of the ink sheet. P designates detection points at which the sensors S1 and Sr1 detect the marks. As illustrated in FIGS. 1 and 2, when the ink sheet is conveyed, the sensor mark or the transfer colorant shields the light, and the detected level crosses the threshold level. At this crossing point, the detection output is provided.

As illustrated in FIGS. 1 and 2, on a transparent base film 4*a* of an ink sheet 4 of this embodiment, a set of 4 transfer colorants of yellow 4*b*, magenta 4*c*, cyan 4*d* and black 4*e*, or alternatively a set of 3 transfer colorants excluding black 4*e* are successively coated or printed while a transparent portion is left on one side of the base film. In the transparent portion on the base film 4*a*, the head sensor mark 4*f* is provided in a boundary between the yellow colorant 4*b*, which is the lead color of the transfer colorants, and the cyan 4*d* or black 4*e* colorant, which is the last colorant. Further, the ID sensor mark 4*h* is provided in a boundary between the yellow 4*b* and magenta 4*c* colorants. As described above, the head sensor mark 4*f*, the transfer colorants and the ID sensor mark 4*h* provided on the ink sheet 4 are respectively detected by the transmission type infrared light sensor S1 and the transmission type red light sensor Sr1. As illustrated in FIG. 3, the red light sensor Sr1 emits the light, the wavelength of which is approximately 650 nm, so that the transmittance of the light is high in the yellow 4*b* and magenta 4*c* colorants and low in other colorants. In general, the transmission type sensors S1 and Sr1 output a signal of shielding at a point P (detection point) where the fall of the sensed level becomes the threshold level, and this signal is discriminated by a control section (not shown in the drawing) so that the conveyance of the ink sheet 4 is controlled.

A relation of positional detection conducted by the ink sheet 4 and the sensors S1 and Sr1 composed in the manner described above will be explained as follows. First, a case will be explained, in which an ink sheet including 4 colorants is used as shown in FIG. 1. When the ink sheet 4 is conveyed, the head sensor mark 4*f* comes right under the infrared light sensor S1. Then the light is shielded and the sensed level of the infrared light sensor S1 is changed. This change is detected, and the conveyance of the ink sheet 4 is stopped at a position where the fore end of the print sheet 3 and that of the yellow colorant 4*b* coincide with the heating line of the thermal head 2, and the printing operation of yellow is carried out. Light emitted by the red light sensor Sr1 is transmitted through the colorants of yellow 4*b* and magenta 4*c*, however, the light is shielded by the ID sensor mark 4*h*. Accordingly, after the yellow colorant has been printed, the ink sheet 4 is conveyed and the ID sensor mark 4*h* comes to a position of the red light sensor Sr1, and a change in the sensed level is detected. Due to the detection of the change in the sensed level, the conveyance of the ink sheet 4 is stopped at a position where the fore end of the colorant of magenta 4*c* coincides with the heating line of the thermal head 2, and the printing operation of magenta is carried out.

Next, when the ink sheet 4 is conveyed to the colorant of cyan 4*d*, the red light sensor Sr1 is shielded by the colorant of cyan 4*d*, and a change in the sensed level is detected, so that the fore end of the colorant of the cyan 4*d* is made to coincide with the heating line of the thermal head 2, and the printing operation of cyan is carried out. When the ink sheet 4 is conveyed to the black 4*e* colorant, a boundary between the cyan 4*d* and black 4*e* colorants passes right under the red light sensor Sr1. Since this boundary portion is transparent, the light emitted from the red light sensor Sr1 is transmitted through this boundary portion, however, the light is shielded by the cyan 4*d* and black 4*e* colorants. Accordingly, when the fore end of the black colorant 4*e* comes to a position of the red light sensor Sr1, a change in the sensed level is detected, and the conveyance of the ink sheet 4 is stopped at a position where the fore end of the black colorant 4*e* coincides with the heating line of the thermal head 2, and the printing operation of the black colorant 4*e* is carried out. In this way, the printing operation of the photographic paper 3 is completed. During this printing operation, the infrared light sensor S1 detects a transparent portion of the base film 4*a*. Therefore, a signal is not sent from the infrared light sensor S1 until it detects the next head sensor mark 4*f*.

Next, a case in which the ink sheet including 3 colorants shown in FIG. 2 is used will be explained as follows. When the ink sheet 4 is conveyed, the head sensor mark 4*f* comes right under the infrared light sensor S1. Then the infrared light sensor S1 is shielded from the light and the sensed level of the infrared light sensor S1 is changed. This change is detected, and the conveyance of the ink sheet 4 is stopped at a position where the fore end of the print sheet 3 and that of the yellow colorant 4*b* coincide with the heating line of the thermal head 2, and the printing operation of yellow is carried out. Light to the red light sensor Sr1 is transmitted through the colorants of yellow 4*b* and magenta 4*c*, however, the ID sensor mark 4*h* shields the light. Accordingly, after the yellow colorant has been printed, the ink sheet 4 is conveyed and the ID sensor mark 4*h* comes to a position of the red light sensor Sr1, and a change in the sensed level is detected. Due to the detection of the change in the sensed level, the conveyance of the ink sheet 4 is stopped at a position where the fore end of the colorant of magenta 4*c* coincides with the heating line of the thermal head 2, and the printing operation of magenta is carried out.

Next, when the ink sheet 4 is conveyed to the colorant of cyan 4*d*, the red light sensor Sr1 is shielded by the colorant of cyan 4*d*, and a change in the sensed level is detected, so that the fore end of the colorant of the cyan 4*d* is made to coincide with the heating line of the thermal head 2, and the printing operation of cyan is carried out. In this way, the printing operation for the print sheet 3 is completed. During this printing operation, the infrared light sensor S1 detects a transparent portion of the base film 4*a*. Therefore, no signal is sent from the infrared light sensor S1 until it detects the next head sensor mark 4*f*.

As described above, according to the ink sheet of the first embodiment, compared with the conventional ink sheet, the sensor mark provided between the magenta 4*c* and cyan 4*d* colorants can be omitted and also the sensor mark provided between the cyan 4*d* and the black 4*e* colorant can be omitted. Therefore, the overall length of the ink sheet can be reduced. Further, the width W3 of the ink sheet becomes narrower than the width W2 of another conventional ink sheet, that is, an inequality of W2>W3>W1 can be satisfied. As a result, an ink sheet roll can be provided, the diameter of which is small, and the width of which is narrow in the axial direction. On the other hand, when the above ink sheet is applied, dimensions of the thermal transfer type color printer can be reduced since the diameter of the ink sheet roll and the width of the roll in the axial direction can be reduced.

In the first embodiment described above, the infrared light sensor S1 is used as the sensor to read the head sensor mark 4*f*, however, when the head sensor mark 4*f* is made of coating material containing carbon black, the light-shielding property of which is high, the infrared light sensor S1 may be replaced with a red or green light sensor which will be described later. Even when the red or green light sensor is used, the same effect can be provided.

Embodiment 2

In general, the sensor mark is made of a coating material containing carbon black capable of shielding the infrared lights, or the sensor mark is made of an aluminum vapor-deposited film. Therefore, in the manufacturing process of the ink sheet, it is necessary to additionally provide a printing or coating process for forming the sensor mark. In this embodiment, as illustrated in FIGS. 3 and 4 in which the sensed level characteristics are shown according to the types of the colorants and sensors, consideration is given to the phenomenon in which the red light is shielded by the cyan 4*d* and black 4*e* colorants. Therefore, in this embodiment, the cyan 4*d* or the black 4*e* colorant itself is used as the head sensor mark 4*f* and the ID sensor mark 4*h*. When the above construction is employed, the number of the ink sheet manufacturing processes can be reduced to be smaller than that of the conventional ink sheet manufacturing processes. Accordingly, the ink sheet can be easily manufactured and the cost can be reduced.

Next, in the second embodiment, as illustrated in FIG. 6, both the sensor for reading the head sensor mark 4*f* and the sensor for reading the ID sensor mark 4*h* and the colorants are composed of the red light sensors Sr1 and Sr2. The construction and operation of the ID sensor mark 4*h* and the red light sensor Sr1 for reading the colorants are the same as those of the first embodiment described before. The light-shielding characteristics of the red light sensor Sr2 for reading the head sensor mark 4*f* are the same as those of the red light sensor Sr1. The red light sensor Sr2 is shielded by the head sensor mark 4*f* made of a coating material containing carbon black and also shielded by the head sensor mark 4*f* composed of a cyan or black colorant. Accordingly, it is possible for the red light sensor Sr2 to detect the head sensor marks 4*f* on the ink sheets of the first and second embodiments. According to the arrangement described above, it is possible to provide a thermal transfer type color printer in which the ink sheet of the first embodiment and that of the second embodiment are commonly used. On the ink sheet of the second embodiment, the sensor marks 4*f* and 4*h* are composed of black or cyan colorant.

Embodiment 3

Figure 7:
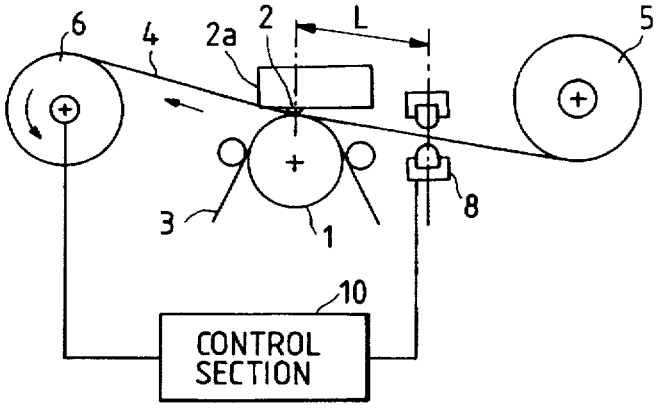
FIG. 7 is a side view showing the primary structure of a thermal transfer type color printer in a third embodiment of the present invention.

FIG. 7 is a side view showing the arrangement of the primary portion of a thermal transfer type color printer of a third embodiment of the present invention. In the drawing, reference numerals 1 to 6 designate the same parts as those explained in the second embodiment. Reference numeral 8 designates a sensor block composed in the manner shown in FIG. 6. The sensor block 8 is located at a position which is separate from the heating line of the thermal head 2 by a predetermined distance L in the upstream of the conveyance direction of the ink sheet 4. Reference numeral 10 designates a control section, which controls the rotation of the platen 1, printing operation of the thermal head 2, and image data processing. Further, the control section 10 controls a drive motor for driving the ink sheet winding roll 6 in accordance with the input signals sent from the sensors S1, Sr1, Sr2 and 9.

Figure 17:
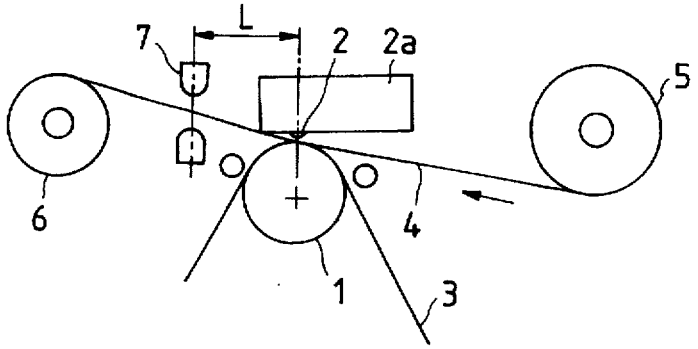
FIG. 17 PRIOR ART
FIG. 17 is a side view showing the primary structure of a conventional thermal transfer type color printer.
Figure 18:
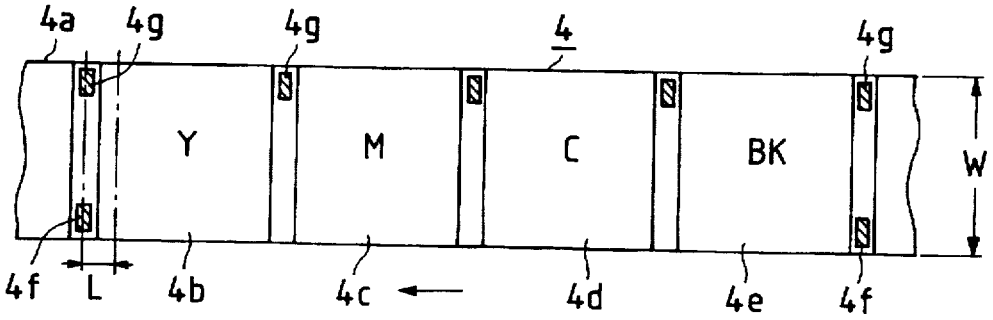
FIG. 18 PRIOR ART
FIG. 18 is a plan view of a conventional ink sheet.
Figure 19:
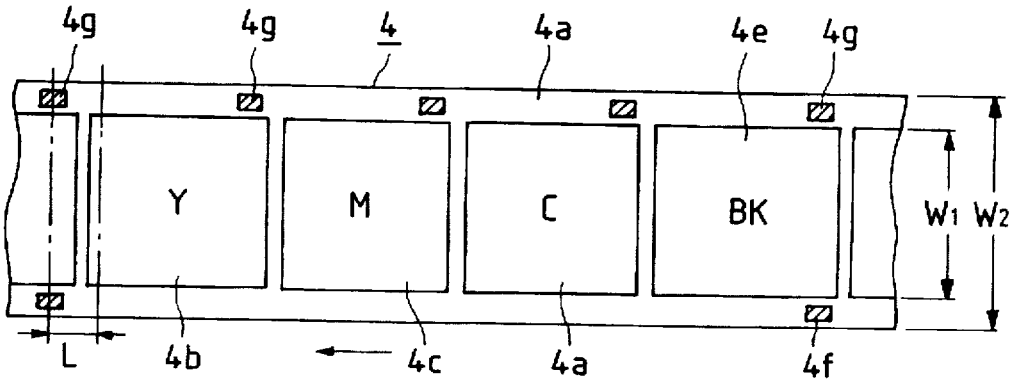
FIG. 19 PRIOR ART
FIG. 19 is a plan view of another conventional ink sheet.

Essentially, it is preferable that the sensor block 8 is provided close to the heating line of the thermal head 2. The reason is described as follows. When the distance L between the heating line of the thermal head 2 and the sensor illustrated in FIG. 17 is reduced, the length of the ink sheet is shortened. However, since the radiating plate 2*a* and a guide roller (not shown) are arranged close to the thermal head 2, it is easier to provide the sensor block 8 at a position separate from the heating line. In this case, a detecting position at which the fore end of each colorant is detected is separate from the heating line of the thermal head 2. Therefore, in the third embodiment of the present invention, there is provided a normal conveyance means for conveying the ink sheet 4 by the distance L from the sensor block 8 to the heating line of the thermal head 2 after the head sensor mark 4*f*, ID sensor mark 4*h* or cyan 4*d* or black 4*e* colorant fore end detecting position has been detected by the sensor S1, Sr1 or Sr2. The ink sheets of the first and second embodiments of the present invention are composed in such a manner that the reduction of transmittance of the colorant in the print region is detected by the red light sensor Sr1 when the light is shielded. Accordingly, when the sensor block 8 is arranged in the upstream direction of the ink sheet conveyance as described in this embodiment, the occurrence of malfunction can be avoided, which occurs when a transparent portion formed after the transfer of colorant in the printing operation is detected by the sensor.

Figure 8:
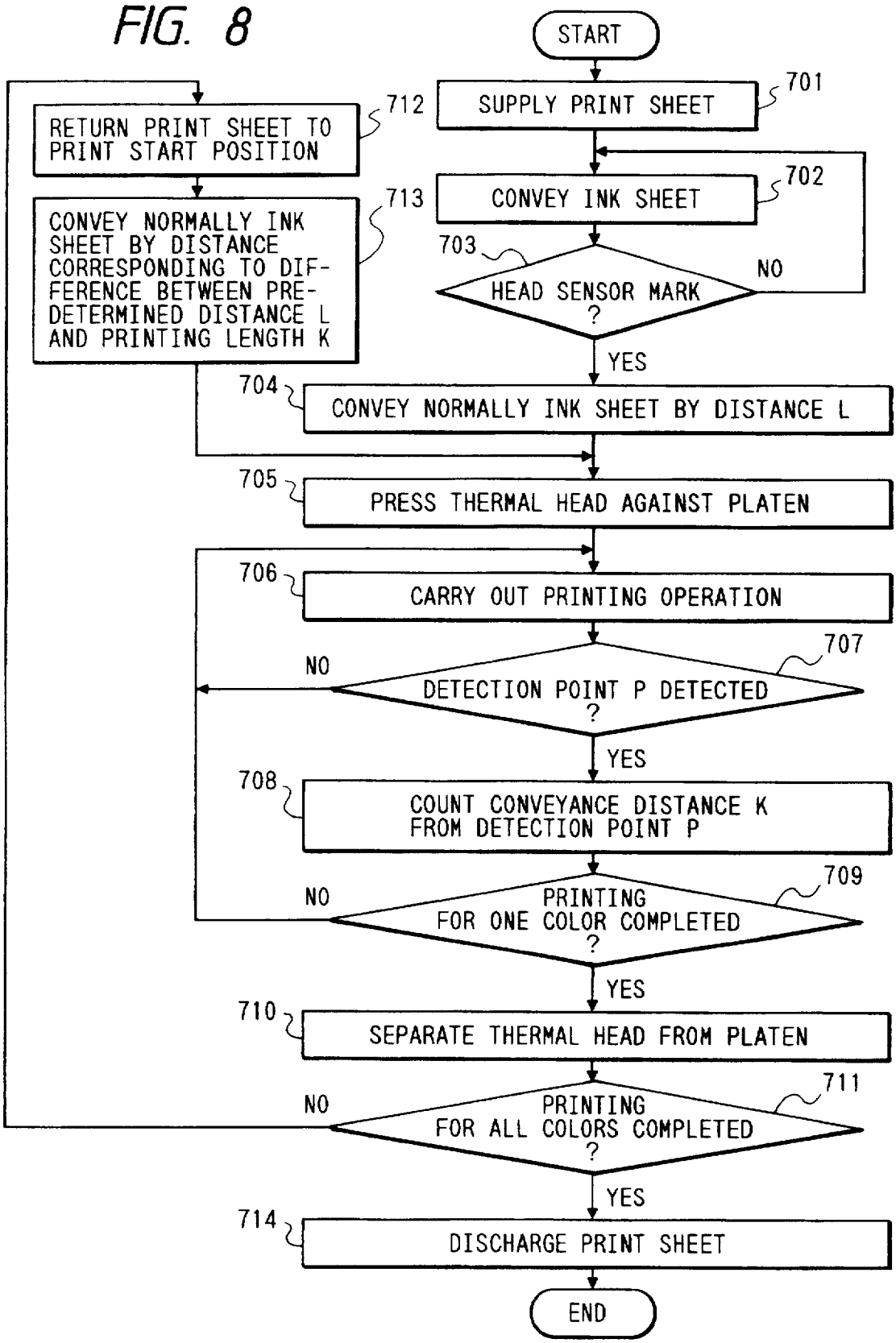
FIG. 8 is a flowchart showing the flow of print processing in the third embodiment of the present invention.

With reference to FIG. 8, the operational control flow of the third embodiment of the present invention will be explained as follows. In accordance with a command to start the printing operation, a print sheet 3 is supplied and sent to the print start position (step 701). Simultaneously with the conveyance of the print sheet 3, the ink sheet 4 is normally conveyed. Then the ink sheet 4 is conveyed until the infrared light sensor S1 or the second red light sensor Sr2 detects the head sensor mark 4*f* (steps 702 and 703). Since the heating line of the thermal head 2 is separate from the sensor block 8 by the distance L, after the head sensor mark 4*f* has been detected, the ink sheet 4 is normally conveyed by the distance L (step 704), so that the fore end of the yellow colorant 4*b* is made to coincide with a position of the heating element of the thermal head 2, and the printing operation is carried out (steps 705 and 706).

While the printing operation is carried out for one color, the ID sensor mark 4*h*, the transfer colorant or the head sensor mark 4*f* shields the detection light, so that the detection point P is detected (step 707). Conveyance distance K of the ink sheet 4 from this detection point P is counted (step 708). After the printing operation has been completed for one color, the print sheet 3 is moved to the print start position, and the ink sheet 4 is normally conveyed by the distance of (L-K), wherein L is the predetermined length, and K is the distance by which the ink sheet 4 has already been conveyed (steps 709 to 713), and then the printing operation is carried out for the next color (steps 705 and 706). In the same manner, the printing operation is carried out for the third and fourth colors, and the image printing operation is completed (step 714).

When the sensor block 8 is arranged in the upstream of the heating line of the thermal head in the conveyance direction of the ink sheet as described above, it is easy to install the sensor block 8. Accordingly, the occurrence of malfunction can be avoided, which occurs when a transparent portion formed after the transfer of colorant of cyan or black in the printing operation is detected by the sensor. Further, after the detection by the sensor, the ink sheet is normally conveyed by the predetermined distance, so that the fore end of each colorant is made to coincide with the heating line of the thermal head. Due to the foregoing, the colorant is not wasted, and the length of the colorant portion on the ink sheet can be minimized, and the overall length of the ink sheet can be reduced.

Embodiment 4

Figure 9:
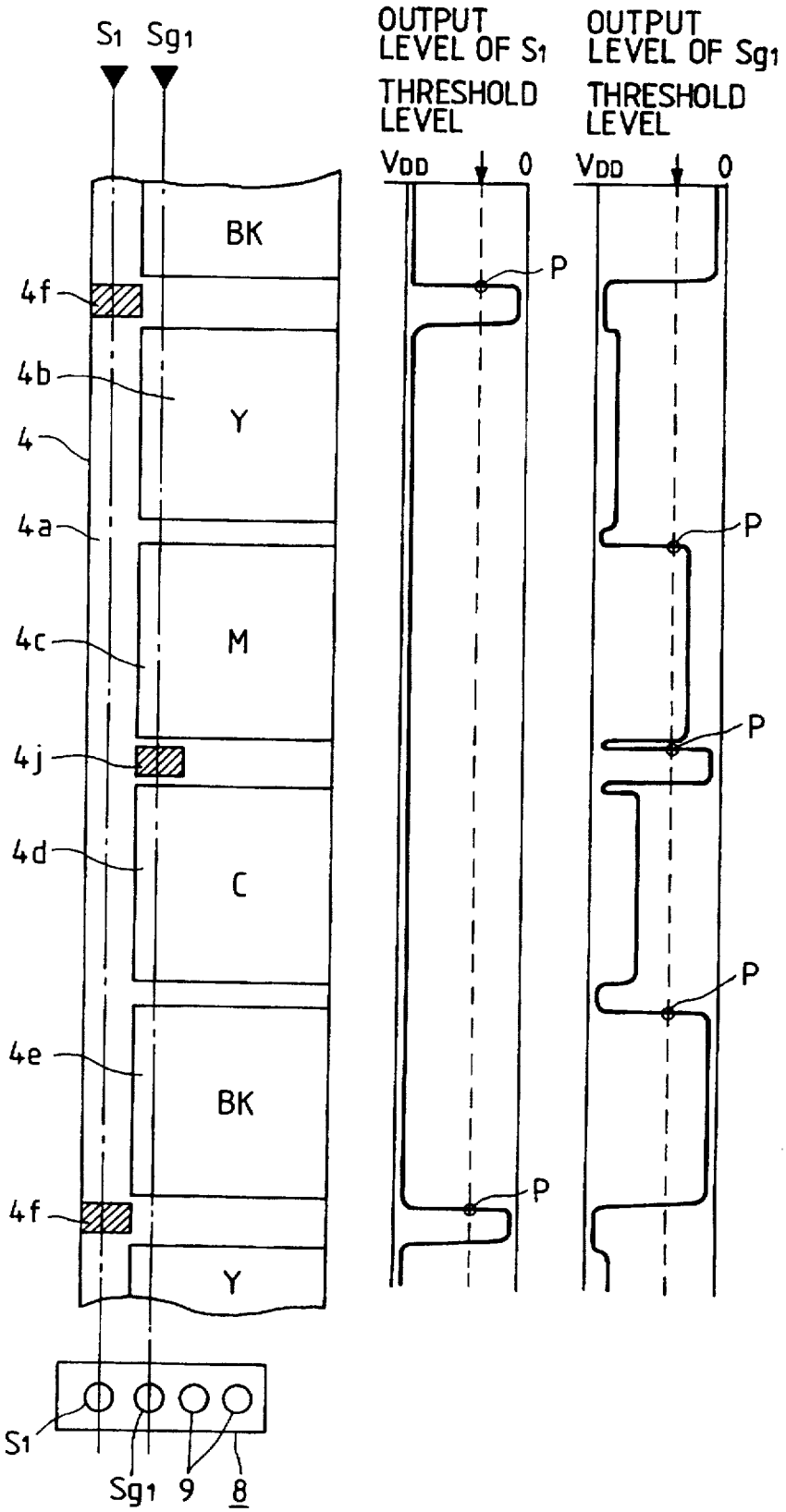
FIG. 9 is a schematic illustration showing a 4-colorant ink sheet and the type and output level of each sensor in a fourth embodiment of the present invention.
Figure 10:
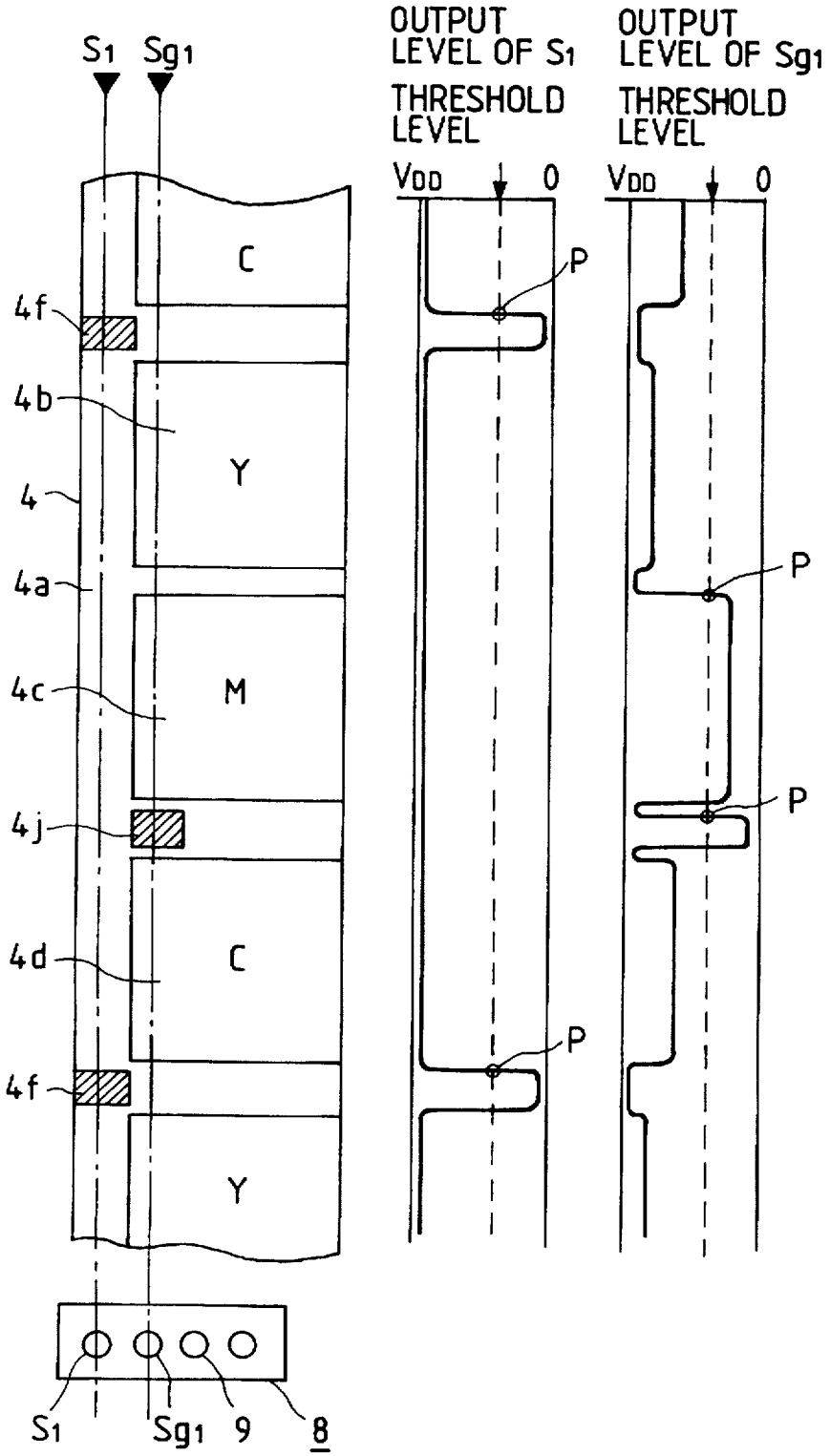
FIG. 10 is a schematic illustration showing a 3-colorant ink sheet and the type and output level of each sensor in the fourth embodiment.

FIGS. 9 and 10 are schematic illustrations showing the ink sheets and sensors and also showing the output levels of the sensors in a fourth embodiment of the present invention. FIG. 9 shows a case in which 4 colorants are used, and FIG. 10 shows a case in which 3 colorants are used. In the drawings, reference numerals 4, 4*a* to 4*f*, 8, 9 and P show the same parts as those explained in the third embodiment. Reference numeral 4*j* designates an identification (ID) sensor mark arranged in a boundary between the magenta 4*c* and the cyan 4*d* colorant.

S1 is a transmission type infrared light sensor for detecting the head sensor mark 4*f*. Sg1 is a transmission type green light sensor arranged at a position where the boundary between the colorants is detected and the ID sensor mark 4*j* is detected. As illustrated in FIG. 3, this green light sensor Sg1 emits light, the wave length of which is approximately 570 nm, so that the transmittance is high in the yellow 4*b* and cyan 4*d* colorants, however, the transmittance is low in the magenta 4*c* and black 4*e* colorants, and also the transmittance is low in the sensor mark made of coating material containing carbon black. The green light sensor Sg1 outputs a signal of light-shielding at the detection point P where the fall of the sensed level reaches the threshold level in the same manner as the infrared light sensor S1.

A relation of the positional detection among the thus composed ink sheet, infrared light sensor S1 and green light sensor Sg1 will be explained below. First, a positional detection in which the ink sheet composed of 4 colorants illustrated in FIG. 9 is used will be explained as follows. When the ink sheet 4 is conveyed, the head sensor mark 4*f* comes right under the infrared light sensor S1. Then the light is shielded by the sensor mark 4*f*, so that the infrared light sensor S1 detects the ink sheet, and the ink sheet 4 is stopped at a position where the fore end of the yellow colorant 4b coincides with the heating line of the thermal head 2. In this way, printing of yellow is carried out. Through the yellow colorant 4b, the light of the green light sensor Sg1 is transmitted, however, by the magenta colorant 4c, the light of the green light sensor Sg1 is shielded. Accordingly, when the fore end of the magenta colorant 4c comes to a position of the green light sensor Sg1 by the conveyance of the ink sheet 4 after the completion of the yellow printing operation, a change in the sensed level is detected, and the ink sheet 4 is stopped at a position where the fore end of the magenta colorant 4c coincides with the heating line of the thermal head 2, and the magenta printing operation is carried out.

Next, when the cyan colorant 4d is conveyed, the green light sensor Sg1 detects the ID sensor mark 4j, and the fore end of the cyan colorant 4d is made to coincide with the heating line of the thermal head 2. In this way, the cyan printing operation is carried out. The light of the green light sensor Sg1 transmits the cyan colorant 4d and the transparent boundary between the cyan 4d and black 4e colorants, and the black colorant 4e shields the light of the green light sensor Sg1. Accordingly, when the ink sheet 4 is conveyed after the cyan printing operation, the fore end of the black colorant 4e shields the light of the green light sensor Sg1 so that a change in the sensed level of the green light sensor Sg1 is detected, and the ink sheet 4 is stopped at a position where the fore end of the black colorant 4e coincides with the heating line of the thermal head 2. In this way, the black printing operation is carried out, and the printing operation conducted on the print sheet 3 is completed. During the above printing operation, the infrared light sensor S1 detects the transparent portion of the base film 4a, so that no signal is sent until the next head sensor mark 4f is detected.

Next, a case in which the ink sheet including 3 colorants shown in FIG. 10 is used will be explained as follows. When the ink sheet 4 is conveyed, the head sensor mark 4f comes right under the infrared light sensor S1. Then the infrared light sensor S1 is shielded from light so that the sensed level of the infrared light sensor S1 is changed. This change is detected, and the conveyance of the ink sheet 4 is stopped at a position where the fore end of the yellow colorant 4b coincides with the heating line of the thermal head 2, and the printing operation of yellow is carried out. Light of the green light sensor Sg1 is transmitted through the yellow colorant 4b, however, the magenta colorant 4c shields the light. Accordingly, after the yellow colorant has been printed, the fore end of the magenta colorant 4c comes to a position of the green light sensor Sg1 when the ink sheet 4 is conveyed. Then, a change in the sensed level is detected. Due to the detection of the change in the sensed level, the conveyance of the ink sheet 4 is stopped at a position where the fore end of the colorant of magenta 4c coincides with the heating line of the thermal head 2, and the printing operation of magenta is carried out.

Next, when the ink sheet is conveyed to a position of the cyan colorant 4d, the green light sensor Sg1 detects the ID sensor mark 4j, and the conveyance of the ink sheet 4 is stopped at a position where the fore end of the cyan colorant 4d coincides with the heating line of the thermal head 2. In this way, the cyan printing operation is carried out and the image printing on the print sheet 3 is completed. During the above printing operation, the infrared light sensor S1 detects the transparent portion of the base film 4a, so that no signal is sent until the next head sensor mark 4f is detected.

As described above, only one identification sensor mark of the colorant boundary may be provided on the ink sheet, so that the overall length of the ink sheet can be reduced shorter than that of a conventional ink sheet. The width W3 can be made narrower than the width W2 of the conventional ink sheet, so that the inequality of W2>W3>W1 can be satisfied. As a result, the roll diameter can be reduced and also the width of the roll can be reduced in the axial direction. When the ink sheet described above is used, the diameter and the width in the axial direction of the ink sheet roll can be reduced. Therefore, the thermal transfer type color printer can be made compact.

Embodiment 5

An ink sheet 4 of a fifth embodiment is composed in such a manner that the magenta 4c or black 4e colorant itself is used as the head sensor mark 4f and the ID sensor mark 4j. As illustrated in FIGS. 3 and 4, in the sensed level characteristics according to the colorants and the types of sensors, the green light sensor is shielded from light by the magenta 4c and black 4e colorants. The inventors paid attention to the above phenomenon. The truth values are the same even when the magenta 4c or black 4e transfer colorant is commonly used for the sensor marks 4f and 4j. Due to the foregoing, in the same manner as that of the second embodiment described above, the number of ink sheet manufacturing processes can be reduced. Therefore, it is possible to provide an ink sheet that can be manufactured easily and the cost of which is inexpensive.

Embodiment 6

Next, an arrangement of the thermal transfer type color printer will be explained below, in which the ink sheet of the fourth embodiment and that of the fifth embodiment (the sensor marks 4f and 4h are composed of the magenta or cyan colorant) can be commonly used. According to this arrangement, both the sensor to read the head sensor mark 4f and the sensor to read the ID sensor mark 4h and the colorants are composed of green light sensors. As shown in the truth table of FIG. 4, the second green light sensor Sg2 is shielded by either the head sensor mark 4f composed of coating material containing carbon black or the head sensor mark 4f composed of colorant of magenta 4c or black 4e. Accordingly, a thermal transfer type color printer to which the ink sheet of the fourth embodiment and that of the fifth embodiment are commonly applied can be provided.

Embodiment 7

With reference to FIGS. 6 and 7, a thermal transfer type color printer of a seventh embodiment will be explained below. In the drawings, reference numerals 1 to 6, 9 an 10 designate the same parts as those explained in the third embodiment. Reference numeral 8 is a sensor block. The sensor block 8 is located at a position which is separate from the heating line of the thermal head 2 by a predetermined distance L in the upstream of the conveyance direction of the ink sheet 4. Essentially, it is preferable that the sensor block 8 is provided close to the heating line of the thermal head 2. However, since the radiating plate 2a and a guide roller (not shown) are arranged close to the thermal head 2, it is easy to provide the sensor block 8 at a position separate from the heating line. In this case, a detecting position at which the fore end of each colorant is detected is separate from the heating line of the thermal head 2. Therefore, in this embodiment of the present invention, there is provided a normal conveyance means for conveying the ink sheet 4 by the distance L from the sensor block 8 to the heating line of the thermal head 2 after the head sensor mark 4f, the ID sensor mark 4j or the magenta 4c or black 4e colorant fore end detecting position has been detected by the sensor S1, Sg1 or Sg2.

When the ink sheet of the fourth or fifth embodiment of the present invention is used for the thermal transfer type color printer, the green light sensor Sg1 is composed in such a manner that the reduction of transmittance is detected as the occurrence of light-shielding. Accordingly, when the sensor block 8 is arranged in the upstream direction of the ink sheet conveyance as described in this embodiment, the occurrence of malfunction can be avoided, which occurs when a transparent portion formed after the transfer of colorant in the printing operation, is detected by the sensor. The explanation of operation of this embodiment is the same as that of the operational flow (shown in FIG. 8) of the third embodiment, so that the explanation will be omitted here.

Due to the foregoing arrangement, in the same manner as that of the third embodiment described before, the sensor block can be easily attached, and the occurrence of malfunction to detect the transparent portion generated when the colorant is printed is prevented, so that the length of the colorant portion on the ink sheet can be minimized, and the overall length of the ink sheet can be reduced.

Embodiment 8

Figure 11:
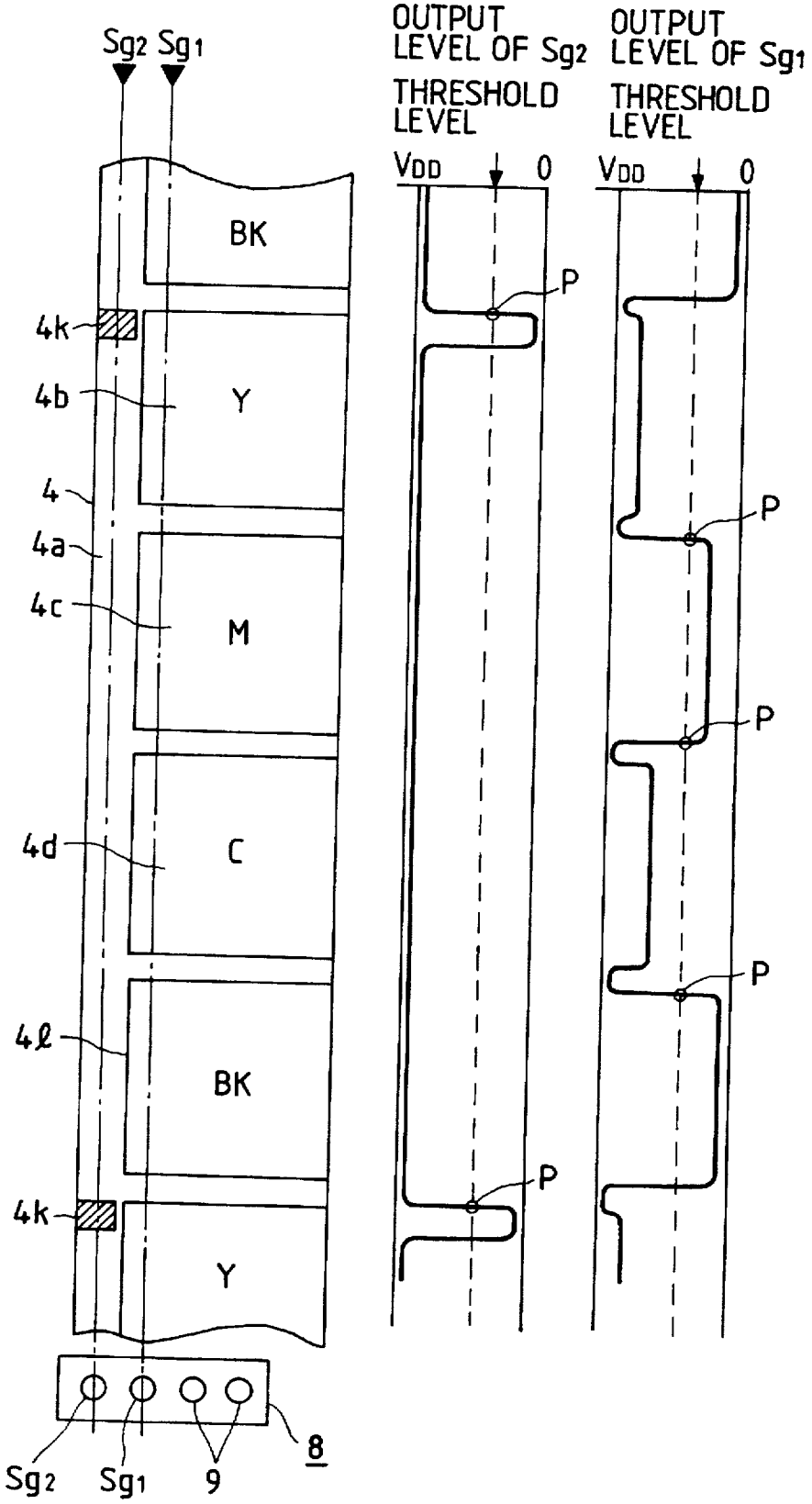
FIG. 11 is a schematic illustration showing a 4-colorant ink sheet and the type and output level of each sensor in an eighth embodiment of the present invention.
Figure 12:
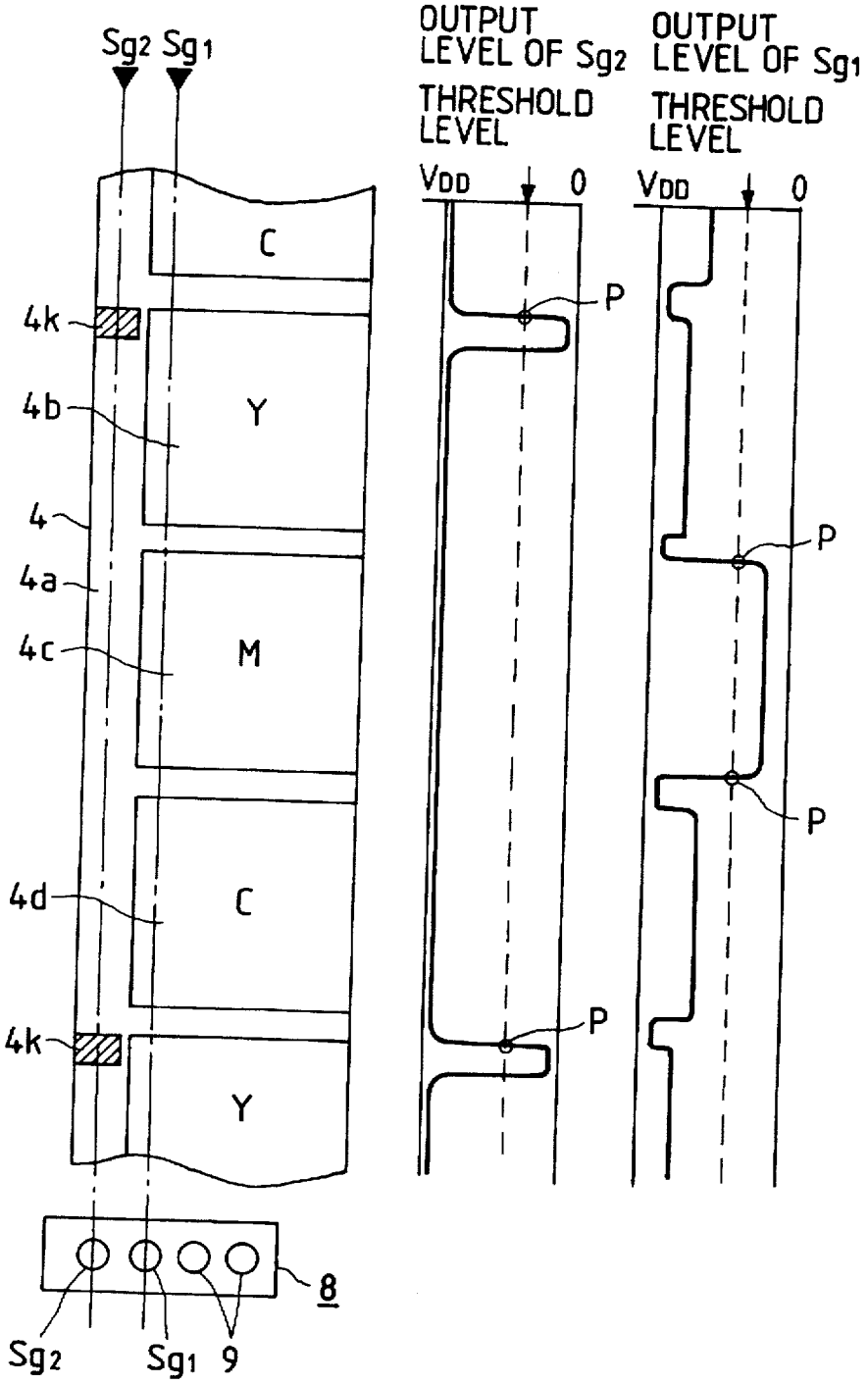
FIG. 12 is a schematic illustration showing a 3-colorant ink sheet and the type and output level of each sensor in the eighth embodiment.

FIGS. 11 and 12 are schematic illustrations showing the ink sheets and sensors and also showing the output levels of the sensors in an eighth embodiment of the present invention. FIG. 11 shows a case in which 4 colorants are used, and FIG. 12 shows a case in which 3 colorants are used. In the drawings, reference numerals 4, 4*a* to 4*e*, 8, 9, P, Sg1 and Sg2 show the same parts as those explained in the seventh embodiment described before. Reference numeral 4*k* is a head sensor mark composed of the black or magenta transfer colorant itself. The head sensor mark 4*k* is arranged at a position of the transparent portion on the ink sheet 4 approximately corresponding to a boundary portion formed between the yellow colorant 4*b*, which is the lead color, and the cyan 4*d* or black 4*e* colorant, which is the last color of the previous set of colors, and the fore end of the sensor mark 4*k* coincides with the fore end of the yellow colorant 4*b*. In this embodiment, the ID sensor marks 4*h* and 4*j* provided on the ink sheet of each embodiment described before are excluded. Due to the foregoing arrangement, the number of ink sheet manufacturing processes can be reduced. Therefore, it is possible to provide an ink sheet that can be manufactured easily and the cost of which is inexpensive. Further, it is possible to manufacture an ink sheet roll, the diameter of which is small, and the width of which is narrow.

In the eighth embodiment, the thermal transfer type color printer is arranged in such a manner that a signal is outputted from the green light sensor Sg1 at a detection point P which is a position where the threshold level is exceeded at both the rise and the fall. A relation of the positional detection between the thus composed ink sheet 4 and green light sensors Sg1 and Sg2 will be explained below. First, a positional detection in which the ink sheet composed of 4 colorants illustrated in FIG. 11 is used will be explained as follows. When the ink sheet 4 is conveyed, the head sensor mark 4*k* comes to a position of the second green light sensor Sg2. Then the light is shielded by the sensor mark 4*k*, so that the green light sensor Sg2 detects the ink sheet, and the ink sheet 4 is stopped at a position where the fore end of the yellow colorant 4*b* coincides with the heating line of the thermal head 2. In this way, printing of yellow is started. Through the yellow colorant 4*b*, the light of the green light sensor Sg1 is transmitted, however, by the magenta colorant 4*c*, the light of the green light sensor Sg1 is shielded. Accordingly, when the fore end of the magenta colorant 4*c* comes to a position of the green light sensor Sg1 by the conveyance of the ink sheet 4 after the completion of the yellow printing operation, a change in the sensed level is detected, and the ink sheet 4 is stopped at a position where the fore end of the magenta colorant 4*c* coincides with the heating line of the thermal head 2, and the magenta printing operation is carried out.

Next, when the ink sheet 4 is conveyed to a position of the cyan colorant 4*d*, the green light sensor Sg1 detects a change in the sensed level caused when the light is transmitted through a transparent boundary portion between the magenta 4*c* and cyan 4*d* colorants, and the end of the magenta colorant 4*c* is detected, so that the fore end of the cyan colorant 4*d* is made to coincide with the heating line of the thermal head 2, and the printing operation of cyan is carried out. The light of the green light sensor Sg1 is transmitted through the cyan colorant 4*d* and the transparent boundary portion between the cyan 4*d* and black 4*e* colorants, and the light is shielded by the black colorant 4*e*. Accordingly, when the ink sheet 4 is conveyed after the cyan printing operation, the light of the green light sensor Sg1 is shielded by the fore end of the black colorant 4*e*, and a change in the sensed level is detected by the green light sensor Sg1 is detected, and the conveyance of the ink sheet 4 is stopped at a position where the fore end of the black colorant 4*e* coincides with the heating line of the thermal head 2. At this position, the black printing operation is carried out. In this way, image printing on the print sheet 3 is completed. During this image printing operation, the second green light sensor Sg2 detects a transparent portion on the base film 4*a*. Therefore, no signal is sent from the second green light sensor Sg2 until the next head sensor mark 4*k* is detected.

Next, a case in which the ink sheet composed of 3 colorants illustrated in FIG. 12 will be explained below. When the ink sheet 4 is conveyed, the head sensor mark 4*k* comes to a position of the second green light sensor Sg2. Then the light of the green light sensor Sg2 is shielded, and the green light sensor Sg2 detects a change in the sensed level. In accordance with this detection, the conveyance of the ink sheet 4 is stopped at a position where the fore end of the yellow colorant 4*b* coincides with the heating line of the thermal head 2, and the yellow printing operation is started. The light of the green light sensor Sg1 is transmitted through the yellow colorant 4*b*, however, the light of the green light sensor Sg1 is shielded by the magenta colorant 4*c*. Accordingly, when the ink sheet 4 is conveyed after the completion of yellow printing operation, the fore end of the magenta colorant 4*c* comes to a position of the green light sensor Sg1, and a change in the sensed level is detected by the sensor, and the conveyance of the ink sheet 4 is stopped at a position where the fore end of the magenta colorant 4*c* coincides with the heating line of the thermal head 2, and the magenta printing operation is carried out.

Next, when the ink sheet 4 is conveyed to a position of the cyan colorant 4*d*, the green light sensor Sg1 detects a change in the sensed level caused when the light is transmitted through a transparent boundary portion between the magenta 4*c* and cyan 4*d* colorants, so that an end of the magenta colorant 4*c* is detected, and the fore end of the cyan colorant 4*d* is made to coincide with the heating line of the thermal head 2, and the cyan printing operation is carried out. In this way, the image printing on the print sheet 3 is completed. During this printing operation, the second green light sensor Sg2 detects a transparent portion of the base film 4*a*. Therefore, no signal is sent from the second green light sensor Sg2 until the next head sensor mark 4*k* is detected.

When the thermal transfer type color printer uses the ink sheet described above, it is possible to reduce the diameter and the width in the axial direction of the ink sheet roll. Therefore, the color printer can be made compact.

Embodiment 9

Figure 13:
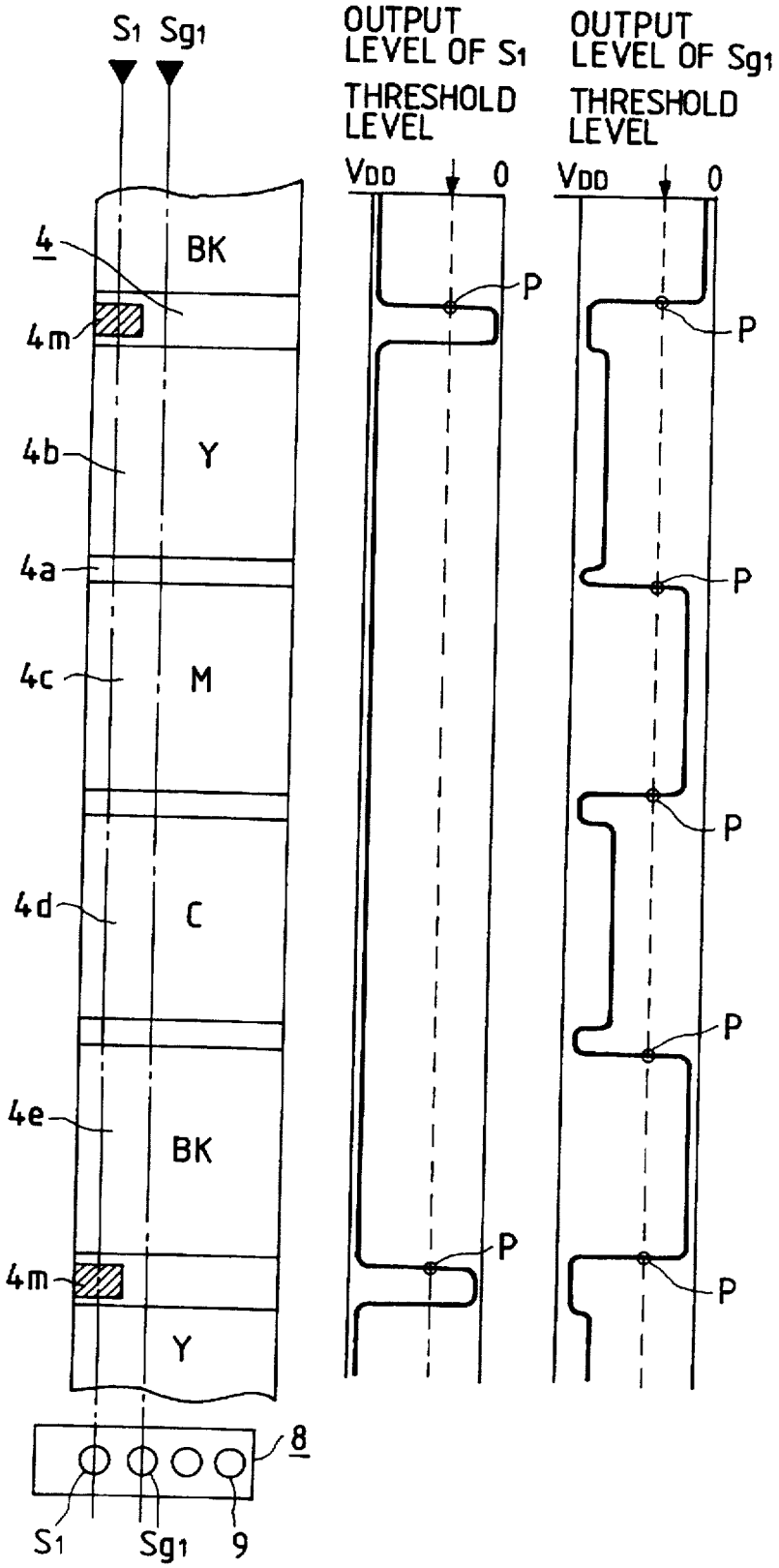
FIG. 13 is a schematic illustration showing a 4-colorant ink sheet and the type and output level of each sensor in a ninth embodiment of the present invention.
Figure 14:
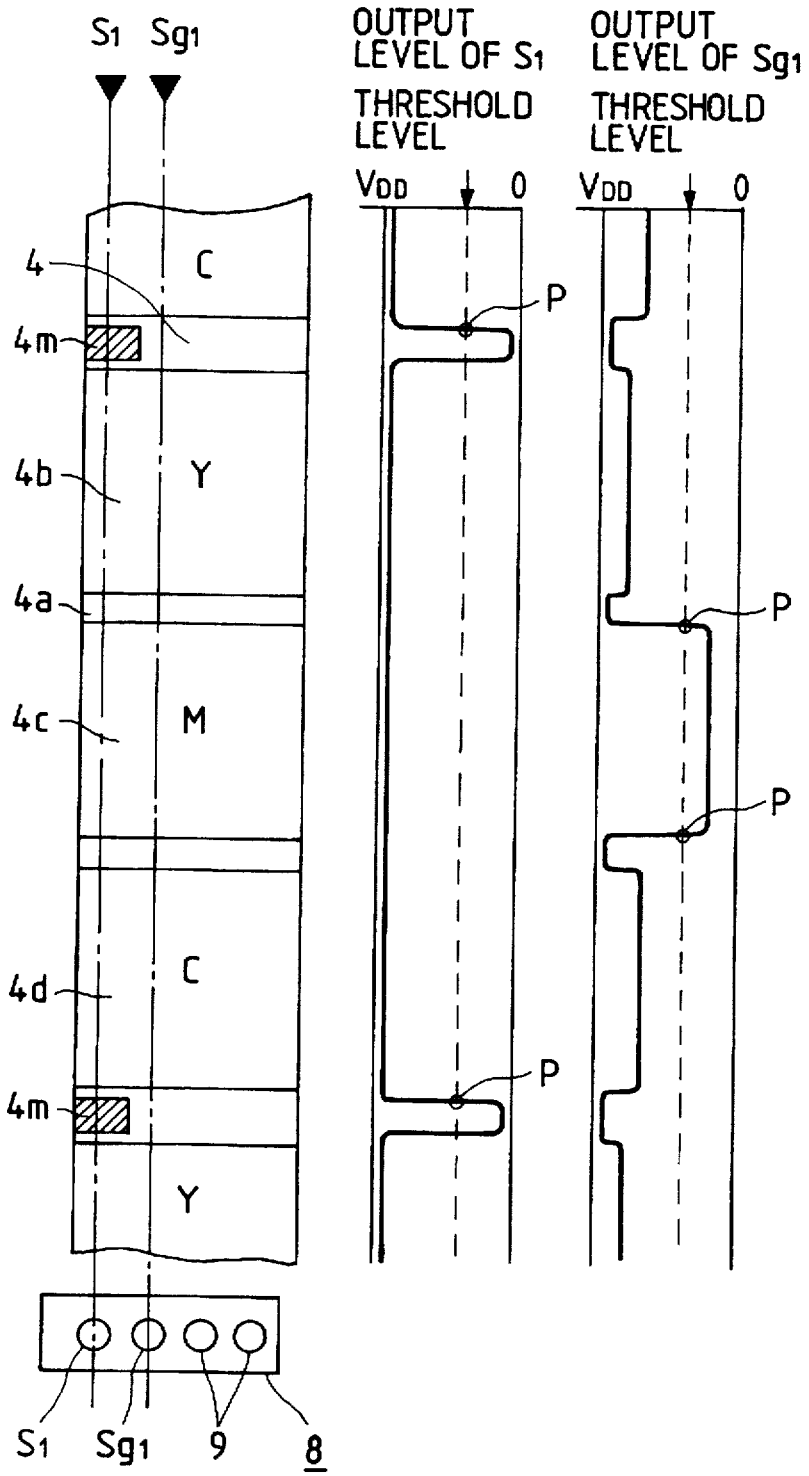
FIG. 14 is a schematic illustration showing a 3-colorant ink sheet and the type and output level of each sensor in the ninth embodiment.

FIGS. 13 and 14 are schematic illustrations showing the ink sheets and the sensors and also showing the output levels of the sensors in a ninth embodiment of the present invention. FIG. 13 shows a case in which 4 colorants are used, and FIG. 14 shows a case in which 3 colorants are used. In the drawings, reference numerals 4*a* to 4*e*, 8, 9, P, S1, and Sg1 show the same parts as those explained in the fourth embodiment. Reference numeral 4 is an ink sheet. Over the entire width of the ink sheet, a set of 4 transfer colorants of yellow 4*b*, magenta 4*c*, cyan 4*d* and black 4*e* are coated or printed, or alternatively a set of 3 transfer colorants of yellow 4*b*, magenta 4*c* and cyan 4*d* are coated or printed. Reference numeral 4*m* is a head sensor mark. The head sensor mark 4*m* is arranged in a boundary between the yellow 4*b* and cyan 4*d* colorants or in a boundary between the yellow 4*b* and black 4*e* colorants, and the head sensor mark 4*m* is composed of a coating material capable of shielding infrared light. Due to the foregoing arrangement, the identification sensor marks conventionally provided in the boundary portion are excluded. Therefore, it is possible to provide an ink sheet, the overall length of which is short, and further it is possible to manufacture an ink sheet roll, the diameter of which is small, and the width of which is narrowest.

In this embodiment, the thermal transfer type color printer is arranged in such a manner that a signal is outputted from the green light sensor Sg1 at a detection point P which is a position where the threshold level is exceeded at both the rise and the fall. A relation of the positional detection between the thus composed ink sheet 4, the infrared light sensor S1 and the green light sensor Sg1 will be explained below. First, a positional detection in which the ink sheet composed of 4 colorants illustrated in FIG. 13 is used will be explained as follows. When the ink sheet 4 is conveyed, the head sensor mark 4*m* comes to a position of the infrared light sensor S1. Then the light is shielded by the sensor mark 4*m*, so that the infrared light sensor S1 detects the ink sheet, and the ink sheet 4 is stopped at a position where the fore end of the yellow colorant 4*b* coincides with the heating line of the thermal head 2. In this way, printing of yellow is started. Through the yellow colorant 4*b*, the light of the green light sensor Sg1 is transmitted, however, by the magenta colorant 4*c*, the light of the green light sensor Sg1 is shielded. Accordingly, when the fore end of the magenta colorant 4*c* comes to a position of the green light sensor Sg1 by the conveyance of the ink sheet 4 after the completion of the yellow printing operation, a change in the sensed level is detected by the sensor, and the ink sheet 4 is stopped at a position where the fore end of the magenta colorant 4*c* coincides with the heating line of the thermal head 2, and the magenta printing operation is carried out.

Next, when the ink sheet 4 is conveyed to a position of the cyan colorant 4*d*, the green light sensor Sg1 detects a change in the sensed level caused when the light is transmitted through a transparent boundary portion between the magenta 4*c* and cyan 4*d* colorants, and the end of the magenta colorant 4*c* is detected, so that the fore end of the cyan colorant 4*d* is made to coincide with the heating line of the thermal head 2, and the printing operation of cyan is carried out. The light of the green light sensor Sg1 is transmitted through the cyan colorant 4*d* and the transparent boundary portion between the cyan 4*d* and black 4*e* colorants, and the light is shielded by the black colorant 4*e*. Accordingly, when the ink sheet 4 is conveyed after the cyan printing operation, the light of the green light sensor Sg1 is shielded by the fore end of the black colorant 4*e*, and a change in the sensed level is detected by the green light sensor Sg1, and the conveyance of the ink sheet 4 is stopped at a position where the fore end of the black colorant 4*e* coincides with the heating line of the thermal head 2. At this position, the black printing operation is carried out. In this way, image printing on the print sheet 3 is completed. During this image printing operation, the infrared light sensor S1 detects a transparent portion on the base film 4*a*. Therefore, no signal is sent from the infrared light sensor S1 until the next head sensor mark 4*k* is detected.

In this case, the distance from the end of the colorant to the heating element of the thermal head in the case where a change in the sensed level of the sensor S1 or Sg1 is detected at the rise is different from the distance in the case where a change in the sensed level of the sensor S1 or Sg1 is detected at the fall. Therefore, the normal conveyance distance of the ink sheet from the detecting position may be changed.

Next, a case in which the ink sheet composed of 3 colorants illustrated in FIG. 14 will be explained below. When the ink sheet 4 is conveyed, the head sensor mark 4*m* comes to a position of the infrared light sensor S1. Then the light of the infrared light sensor S1 is shielded, and the infrared light sensor S1 detects a change in the sensed level. In accordance with this detection, the conveyance of the ink sheet 4 is stopped at a position where the fore end of the yellow colorant 4*b* coincides with the heating line of the thermal head 2, and the yellow printing operation is started. The light of the green light sensor Sg1 is transmitted through the yellow colorant 4*b*, however, the light of the green light sensor Sg1 is shielded by the magenta colorant 4*c*. Accordingly, when the ink sheet 4 is conveyed after the completion of yellow printing operation, the fore end of the magenta colorant 4*c* comes to a position of the green light sensor Sg1, and a change in the sensed level is detected by the sensor, and the conveyance of the ink sheet 4 is stopped at a position where the fore end of the magenta colorant 4*c* coincides with the heating line of the thermal head 2, and the magenta printing operation is carried out.

Next, when the ink sheet 4 is conveyed to a position of the cyan colorant 4*d*, the green light sensor Sg1 detects a change in the sensed level caused when the light is transmitted through a transparent boundary portion between the magenta 4*c* and cyan 4*d* colorants, so that an end of the magenta colorant 4*c* is detected, and the fore end of the cyan colorant 4*d* is made to coincide with the heating line of the thermal head 2, and the cyan printing operation is carried out. In this way, the image printing on the print sheet 3 is completed. During this printing operation, the infrared light sensor S1 detects a transparent portion of the base film 4*a*. Therefore, no signal is sent from the infrared light sensor S1 until the next head sensor mark 4*k* is detected.

When the thermal transfer type color printer uses the ink sheet described above, it is possible to reduce the diameter and the width in the axial direction of the ink sheet roll. Therefore, the color printer can be made compact.

A sublimation type ink sheet composed of 3 or 4 colorants and a fusion type ink sheet composed of 3 colorants can be applied to the thermal transfer type color printer in the ninth embodiment. The reason for this is described as follows. Since the light of the infrared light sensor S1 is shielded by the fusion type black colorant 4*e* (shown in FIG. 14), it is impossible to discriminate between the detection of light-shielding by the black colorant 4*e* and the detection of light-shielding by the head sensor mark 4*k*. Therefore, in a tenth embodiment, an arrangement of a thermal transfer type color printer to which an ink sheet including the fusion type 4 colorants is applied will be explained.

Embodiment 10

Figure 15:
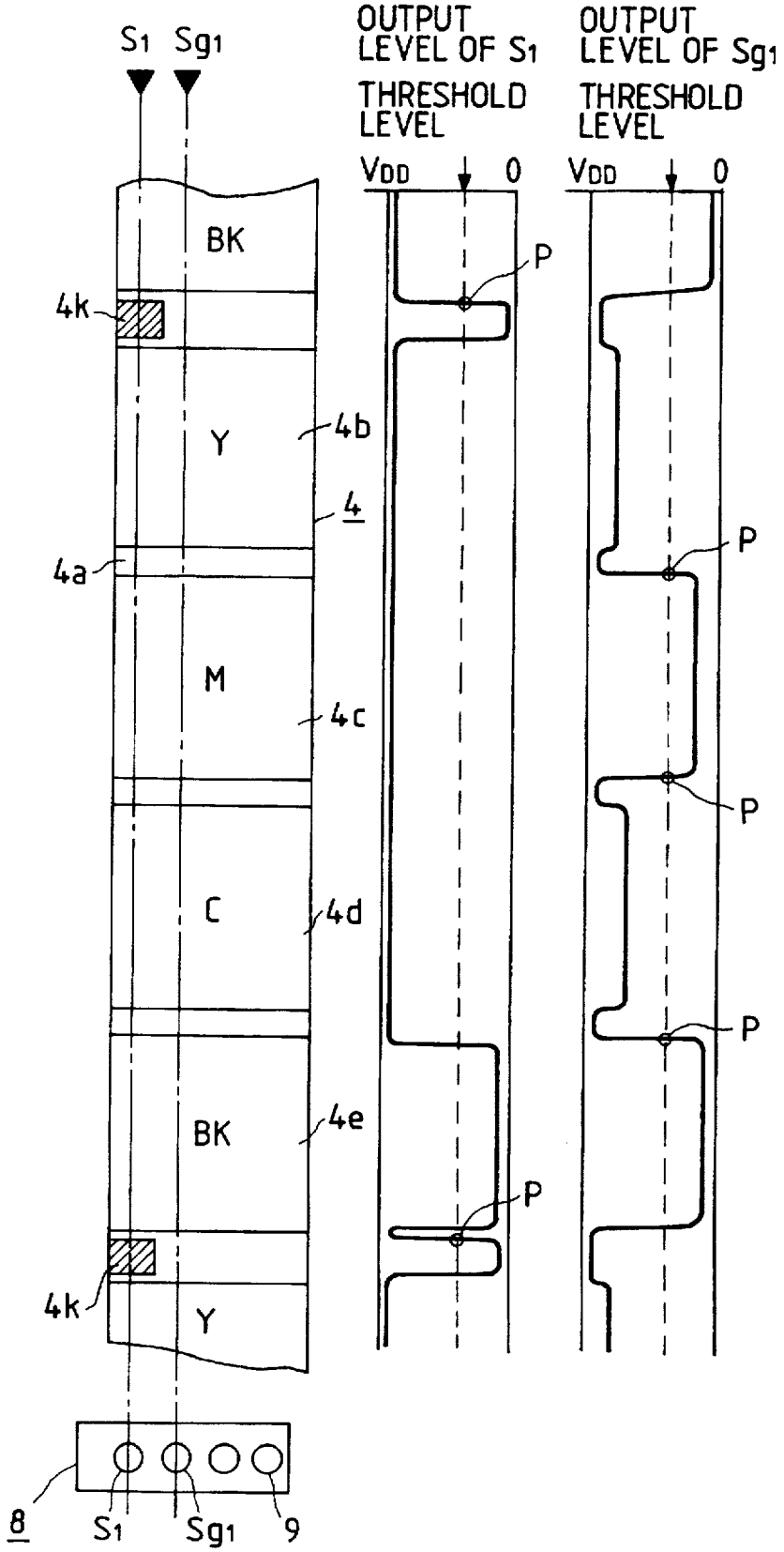
FIG. 15 is a schematic illustration showing a fusion type 4-coloring ink sheet and output levels of infrared light sensor and green light sensor.

FIG. 15 is a schematic illustration showing a fusion type 4-colorant ink sheet and also showing the output levels of the infrared and green light sensors. In FIG. 15, reference numerals 4*a* to 4*d*, 4*k*, 8, 9, P, S1 and Sg1 are the same parts as those explained in the ninth embodiment described above. A difference between the tenth embodiment and the ninth embodiment shown in FIG. 13 is that the transfer colorants are of a fusion type in the tenth embodiment. Therefore, the infrared light sensor S1 is shielded by the black colorant 4*e*. Accordingly, when the black colorant 4*e* comes to a position right under the infrared light sensor S1, the same detection signal as that of the detection of the head sensor mark 4*k* is outputted by the infrared light sensor S1. On the other hand, the green light sensor Sg1 is also shielded from the light at this time. As described above, as shown in the truth table of FIG. 4, only when the fusion type black colorant 4*e* is employed, both the infrared light sensor S1 and the green light sensor Sg1 are put into the light-shielding condition. When attention is paid to this phenomenon, the AND condition in which both the green light sensor Sg1 and the infrared light sensor S1 are shielded from the light can be determined to be the condition of the fusion type black colorant 4*e*.

Figure 16:
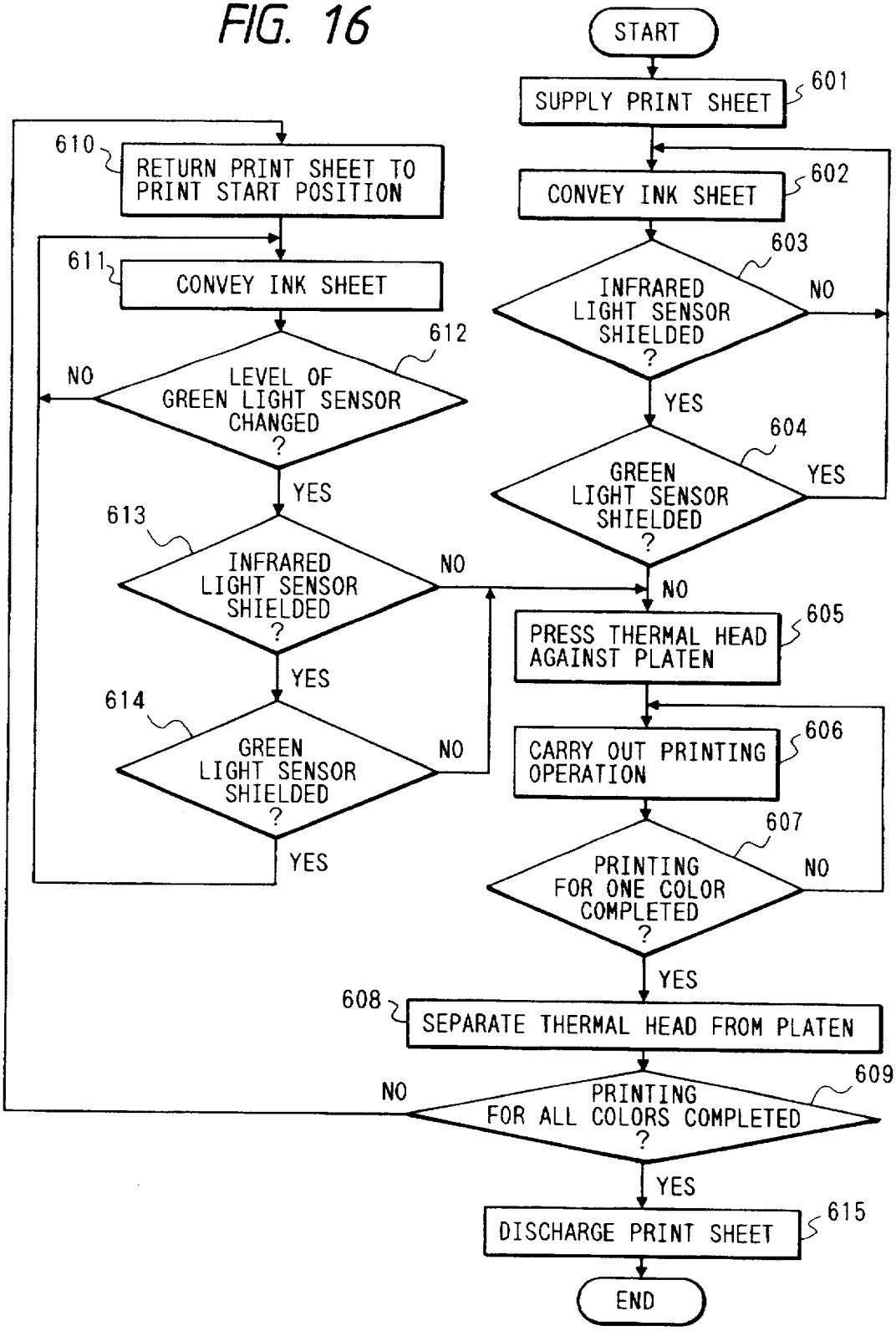
FIG. 16 is a flowchart showing the flow of print processing in the tenth embodiment.

In FIG. 16, a processing flow is shown, in which the printing operation can be carried out in either case of a fusion type colorant or a sublimation type colorant. This processing flow will be explained below. In accordance with a command of start of printing, a print sheet 3 is fed and sent to the printing start position (step 601). At the same time, the ink sheet 4 is normally conveyed, and the conveyance of the ink sheet 4 is continued until the infrared light sensor S1 of the sensor block 8 is shielded from the light (steps 602 and 603). When the green light sensor Sg1 is shielded from the light at this time, it is judged that the colorant is the fusion type black colorant 4*e*, and the ink sheet 4 is further conveyed. In the case where the green light sensor Sg1 is transmitted and the infrared light sensor S1 is shielded from the light, it is the detection of the head sensor mark 4*k*. Therefore, the printing of the first color is carried out (steps 604 to 606). After the first color image has been printed, the print sheet 3 is returned to the printing start position, and at the same time the ink sheet 4 is conveyed (steps 607 to 611).

A point of time at which the detection level of the green light sensor Sg1 is changed during the conveyance of the ink sheet 4 is determined to be the detection of the fore end of each colorant (step 612). When the infrared light sensor S1 is transmitted at this time, the process advances to the next printing operation. When the infrared light sensor S1 is shielded from the light, it is checked whether the green light sensor Sg1 is shielded or transmitted (step 613). In the case where the green light sensor Sg1 is shielded from the light, it is judged that the infrared light sensor S1 has been shielded from the light by the fusion type black colorant, and the printing operation is carried out. In the case where the green light sensor Sg1 is transmitted, it is judged that the infrared light sensor S1 has been shielded from the light by the head sensor mark 4*k* (step 614). Thereafter, when the printing operation for all the colors has been completed, the print sheet 3 is discharged (steps 609 and 615).

According to the arrangement described above, it is possible to provide a thermal transfer type color printer in which the fusion type and the sublimation type ink sheet can be commonly used.

Since the present invention is composed in the manner described above, the following effects can be provided.

According to the invention, it is possible to detect the fore end of the lead colorant by the head sensor mark, and also it is possible to detect the fore end of the colorant by the identification sensor mark or the colorant itself. Consequently, it is sufficient that only one identification sensor mark is provided for the sensor mark of the colorant boundary portion. Therefore, the overall length of the ink sheet can be reduced. Further, it is not necessary to provide an exclusive space in the width of the ink sheet for installing the identification sensor mark in the axial direction. Accordingly, the ink sheet width can be reduced. As a result, it is possible to provide an ink sheet roll, the diameter of which is small, and the width of which is narrow in the axial direction.

What is claimed is:

1. An ink sheet comprising:

a set of transfer colorants including 3 colors of yellow, magenta and cyan or 4 colors of yellow, magenta, cyan and black, said transfer colorants being successively coated or printed on a transparent base film corresponding to an area of a print sheet while a transparent portion is left on one side of the base film;

head sensor marks provided only at positions in the transparent portion of the base film, said positions each corresponding to a boundary between the yellow colorant which is the lead color, and the cyan or black colorant which is the last color of each color set; and identification sensor marks provided only at boundaries between the yellow and magenta colorants.

2. The ink sheet according to claim 1, wherein said head sensor marks and said identification sensor mark are composed of a black or cyan transfer colorant.

3. A thermal transfer type color printer using an ink sheet, said ink sheet comprising: a set of transfer colorants including 3 colors of yellow, magenta and cyan or 4 colors of yellow, magenta, cyan and black, said transfer colorants being successively coated or printed on a transparent base film corresponding to an area of a print sheet while a transparent portion is left on one side of the base film; head sensor marks provided only at positions in the transparent portion on the base film, said positions each corresponding to a boundary between the yellow colorant which is the lead color, and the cyan or black colorant which is the last color of each color set; and identification sensor marks provided only at boundaries between the yellow and magenta colorants, said color printer comprising:

a red light sensor for detecting said identification sensor marks to control a conveyance of said ink sheet; and an infrared light sensor for detecting said head sensor marks, said infrared light sensor being arranged in parallel with said red light sensor.

4. The thermal transfer type color printer according to claim 3, further comprising: first and second sensors arranged in an upstream of a heating line of a thermal head in an ink sheet conveyance direction; and normal conveyance means for conveying the ink sheet in a normal direction by a predetermined distance after the sensor mark or the black or cyan transfer colorant has been detected.

5. A thermal transfer type color printer using an ink sheet, said ink sheet comprising: a set of transfer colorants including 3 colors of yellow, magenta and cyan or 4 colors of yellow, magenta, cyan and black, said transfer colorants being successively coated or printed on a transparent base film corresponding to an area of a print sheet while a transparent portion is left on one side of the base film; head sensor marks provided only at positions in the transparent portion on the base film, said positions each corresponding to a boundary between the yellow colorant which is the lead color, and the cyan or black colorant which is the last color of each color set; and identification sensor marks provided only at boundaries between the yellow and magenta colorants, said color printer comprising:

a first red light sensor for detecting said identification sensor marks to control a conveyance of said ink sheet; and a second red light sensor for detecting said head sensor marks, said second red light sensor being arranged in parallel with said first red light sensor.

6. The thermal transfer type color printer according to claim 5, further comprising: first and second sensors arranged in an upstream of a heating line of a thermal head in an ink sheet conveyance direction; and normal conveyance means for conveying the ink sheet in a normal direction by a predetermined distance after the sensor mark or the black or cyan transfer colorant has been detected.

7. A thermal transfer type color printer using an ink sheet, said ink sheet comprising: a set of transfer colorants including 3 colors of yellow, magenta and cyan or 4 colors of yellow, magenta, cyan and black, said transfer colorants being successively coated or printed on a transparent base film corresponding to an area of a print sheet while a transparent portion is left on one side of the base film; head sensor marks provided only at positions in the transparent portion on the base film, said positions each corresponding to a boundary between the yellow colorant which is the lead color, and the cyan or black colorant which is the last color of each color set, said color printer comprising:

a first green light sensor for detecting a fore end of each colorant to control a conveyance of the ink sheet; and a second green light sensor for detecting said head sensor marks, said second green light sensor being arranged in parallel with said first green light sensor.

8. A thermal transfer type color printer using an ink sheet, said ink sheet comprising: a set of transfer colorants including 3 colors of yellow, magenta and cyan or 4 colors of yellow, magenta, cyan and black, said transfer colorants being successively coated or printed on a transparent base film over the entire width corresponding to an area of a print sheet; and head sensor marks provided only at positions on the base film each corresponding to a boundary between the yellow colorant which is the lead color, and the cyan or black colorant which is the last color of each color set, said head sensor marks being composed of a coating material capable of shielding infrared light, said color printer comprising:

an infrared light sensor for detecting said head sensor marks to control a conveyance of the ink sheet; and a green light sensor for detecting a fore end of each colorant, said green light sensor being arranged in parallel with said infrared light sensor.

9. The thermal transfer type color printer according to claim 8, further comprising means for detecting a fusion type black colorant when an AND condition is satisfied between the light-shielding of said infrared light sensor and the light-shielding of said green light sensor.

10. An ink sheet comprising:

a set of transfer colorants including 3 colors of yellow, magenta and cyan or 4 colors of yellow, magenta, cyan and black, said transfer colorants being successively coated or printed on a transparent base film corresponding to an area of a print sheet while a transparent portion is left on one side of the base film;

head sensor marks provided only at positions in the transparent portion on the base film, said positions each corresponding to a boundary between the yellow colorant which is the lead color, and the cyan or black colorant which is the last color of each color set.

* * * * *